United States Patent [19]

Shimomura et al.

[11] Patent Number: 5,052,945

[45] Date of Patent: Oct. 1, 1991

[54] CONTACT FOR CONNECTION OF A SHIELDED WIRE

[75] Inventors: Keiko Shimomura, Muko; Tomoya Ijiri, Kameoka, both of Japan

[73] Assignee: Omron Tateisi Electronics Co., Kyoto, Japan

[21] Appl. No.: 575,494

[22] Filed: Aug. 30, 1990

Related U.S. Application Data

[63] Continuation-in-part of Ser. No. 436,887, Nov. 15, 1989.

[30] Foreign Application Priority Data

Nov. 15, 1988 [JP] Japan ..... 63-148044

[51] Int. Cl.[5] ..... H01R 4/24

[52] U.S. Cl. ..... 439/394; 439/865

[58] Field of Search ..... 439/578–585, 439/421, 423, 424, 394, 397, 865, 877, 882, 607, 610; 29/874, 866, 865, 863, 862, 857, 882

[56] References Cited

U.S. PATENT DOCUMENTS

| | | | |
|---|---|---|---|
| 2,873,434 | 2/1959 | Drum et al. | 439/423 |
| 3,194,877 | 7/1965 | Collier | 439/424 X |
| 3,828,298 | 8/1974 | Schumacher | 439/394 X |
| 4,169,646 | 10/1979 | Stape et al. | 439/397 |
| 4,708,414 | 11/1987 | Lam | 439/394 |

FOREIGN PATENT DOCUMENTS

| | | | |
|---|---|---|---|
| 2601196 | 1/1988 | France | 439/394 |

*Primary Examiner*—Neil Abrams
*Assistant Examiner*—Khiem Nguyen
*Attorney, Agent, or Firm*—Foley & Lardner

[57] ABSTRACT

A contact is provided for connection of a shielded wire. The contact is formed from a strip of metal bent generally in a U-shape, at least two pairs of elastic projections with a sharp piercing ends formed on the strip, and at least one end of the U-shaped portion forming a wire-retaining portion. The first pair of projections is biased outwardly and the second pair is biased inwardly.

5 Claims, 3 Drawing Sheets

CONTACT FOR CONNECTION OF A SHIELDED WIRE

This is a continuation in part of application Ser. No. 07/436,887, filed Nov. 15, 1989.

BACKGROUND OF THE INVENTION

1. Field of the Invention

The present invention relates to a contact for connecting electric parts to the shield of a shielded wire.

2. Discussion of the Related Art

The shielded wire generally comprises a conductor, an insulation tube sleeved over the conductor, a braided metal shield covering the tube, and an insulation sheath covering the braided metal shield.

In order to connect an electric part to the metal shield of the shielded wire, typically the outermost sheath and the shield are removed a given distance to expose a necessary length of the insulation tube and conductor. The sheath is then peeled off to expose the shield, and the shield is connected to the part by soldering, for instance. As many electrical engineers have experienced, it is a very tedious operation to peel off the sheath of a shielded wire. In addition, when this operation is done on production lines in a factory, it requires many steps and leads to an increased cost of production.

SUMMARY OF THE INVENTION

Accordingly, it is an object of the present invention to provide a contact with which electrical connection of parts to the shield of a shielded wire can be easily established.

The foregoing and additional objects are attained by providing a contact for a shielded wire comprising a strip of metal which is bent generally in a U-shape, wherein at least one end of the U-shaped portion includes a wire-retaining portion. At least one projection having a piercing end for engaging the shielded wire is formed on the strip, preferably along the base of the "U".

DETAILED DESCRIPTION OF THE PREFERRED EMBODIMENTS

Figure 1:
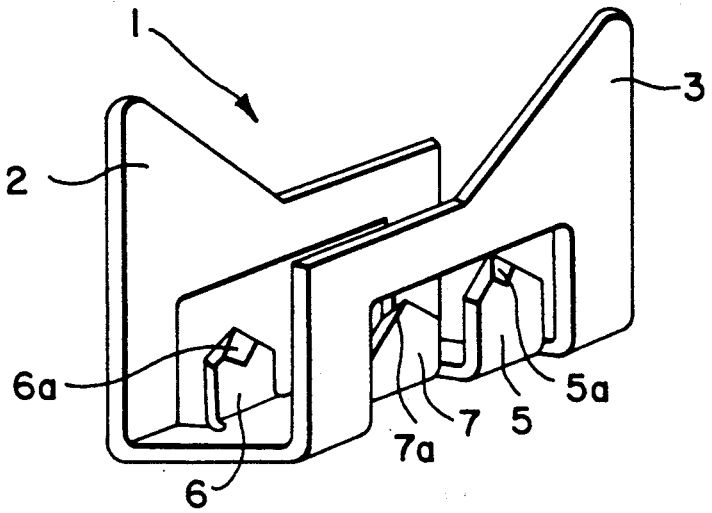
FIG. 1 is a perspective view of a contact according to a preferred embodiment of the present invention.
Figure 2:
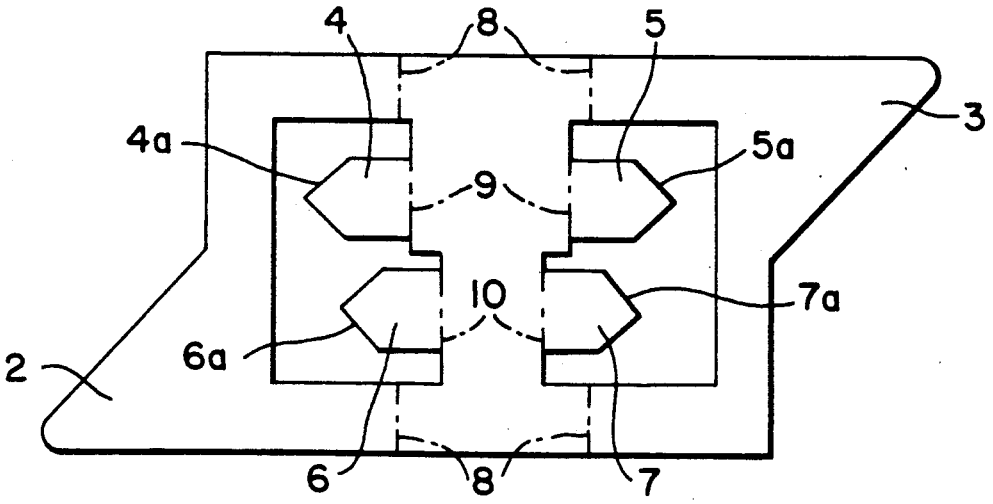
FIG. 2 is an unfolded plan view of the contact of FIG. 1.

Referring to FIG. 1, which illustrates a preferred embodiment of the present invention, a contact indicated by the reference numeral 1 is a press-formed strip of metal which is highly electrically conductive and easy to machine, such as brass. To manufacture this contact, a metal sheet is press-formed to the overall shape illustrated in FIG. 2. This metal strip is formed at both ends with generally triangular wire-retaining portions 2, 3 in staggered relation, and a first set of projections 4, 5 and a second set of projections 6, 7 extend from a common base of the strip. While all the projections of said first and second sets are identical in size and height, as illustrated, the second set of projections 6, 7 are displaced toward the center from the first set of projections 4, 5.

The metal strip punched out in the above manner is bent inwardly at right angles along broken lines 8, 9, 10. This gives the contact a generally U-shaped configuration with both of the first set of projections 4, 5 and second set of projections 6, 7 extending at right angles from their common base. It should be understood that the base portion of the U-shaped strip may be arcuate. Finally, the piercing edges 4*a*, 5*a*, 6*a*, 7*a* of the projections 4, 5, 6, 7 are sharpened.

Figure 3:
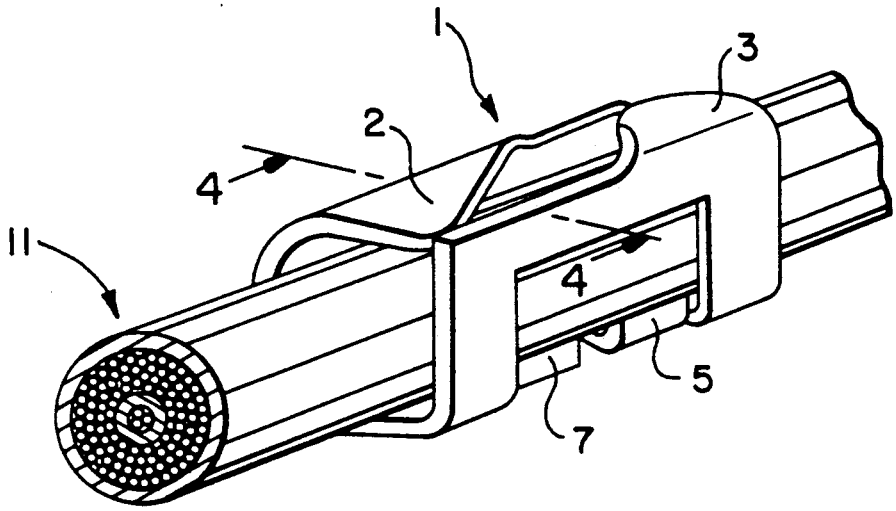
FIG. 3 is a perspective view showing a shielded wire connected to the folded contact.
Figure 4:
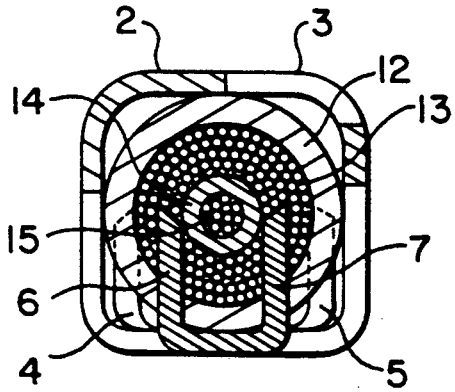
FIG. 4 is a transverse sectional view taken along line IV—IV of FIG. 3.

As illustrated in FIG. 3, a shielded wire 11 to be connected is forced into the contact 1 and the wire-retaining portions 2, 3 of the contact are bent inwardly to enclose the wire 11. Thus, as illustrated in FIG. 4, the projections 4, 5 of said first set pierce the boundary between the sheath 12 and shield 13 of the wire, thereby to establish a connection between the contact 1 and the shield 13 of the wire. It should be understood that in order for the projections 4, 5, 6, 7 not to contact the conductor 15, both side walls of the contact 1 are designed to guide and support the sheath 12, and the distance across projections 4 and 5 and that across projections 6, 7 must be properly determined.

While in the above embodiment, the contact 1 has four projections for piercing the shield 13 of the shielded wire 11, it may also be arranged so that only the first set of projections 4, 5 or the second set of projections 6, 7 is provided. The provision of the second set of projections, which, in the shown embodiment, engages into the shield 13 and surround insulating tube 14 and conductor 15, is preferred due to increased contact area. Furthermore, since either side wall of the contact will serve as a positioning guide, piercing projections may be provided only on one side or, alternatively, only one projection may be provided. Furthermore, each of the wire-retaining portions 2, 3 may be bent over the edge of the other side wall or only one side wall may be formed with a wire-retaining position. The shape, size and number of wire-retaining portions can also be optionally selected.

Figure 5A:
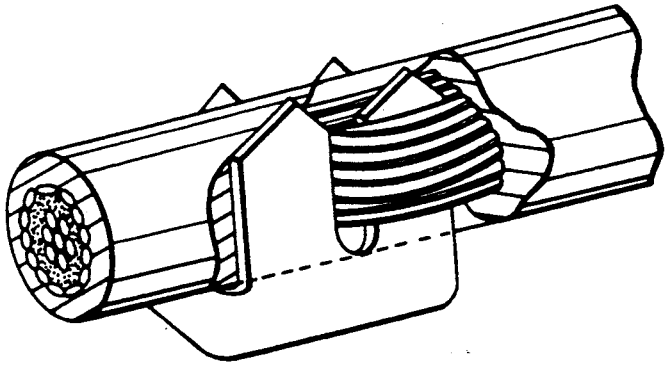
FIG. 5A is a partial perspective view of a contact according to a second preferred embodiment of the present invention.
Figure 5B:
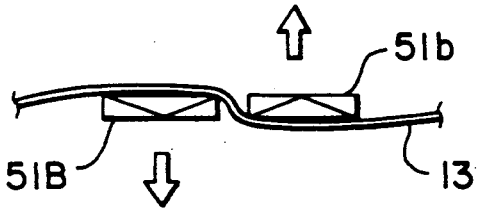
FIG. 5B is a top view of a portion of the contact of FIG. 1.

In another embodiment of this invention, the second set of projections are not displaced towards the center; the projection bases of the two pairs are parallel. Additionally, both pairs of projections are elastic. However, as shown in FIG. 5B, the first pair is formed to be outwardly biased by the shielded wire and the second pair is formed to be inwardly biased by the shielded wire, when the shielded wire is inserted into the U-shaped strip. Thus, as can be seen in FIG. 5A, the first pair of projectors 51A, 51B only abut the shield 13 while the second set of projections 51*a* and 51*b* penetrate shield 13. In addition, as reflected in FIG. 5B, projection 51*b* is formed to have a top end having a gradient which extends upwardly toward the shielded wire while projection 51B has a top end having a gradient which extends upwardly away from the shielded wire.

With the contact according to the invention described above, the time-consuming sheath peeling operation previously required can be eliminated, so that dramatic cost reduction can be made.

The above description and the accompanying drawings are merely illustrative of the application of the principles of the present invention and are not limiting.

Numerous other arrangements which embody the principles of the invention and which fall within its spirit and scope may be readily devised by those skilled in the art. Accordingly, the invention is not limited by the foregoing description, but is only limited by the scope of the appended claims.

What is claimed is:

1. A contact for connection with a shielded wire, comprising:

a metal strip bent generally into a U-shape;

retaining means for retaining a shielded wire; and two pairs of elastic projections with sharp piercing ends formed on said strip, wherein the first pair of projections is formed to be biased outwardly by the shielded wire when the shielded wire is inserted into the U-shaped strip and the second pair of projections is formed to be biased inwardly when the shielded wire is inserted into the U-shaped strip.

2. The contact according to claim 1, wherein said first set of projections abuts a shield of the shielded wire and the second set of projections penetrates said shield.

3. The contact according to claim 2, wherein the distance between the bases of the projections of each pair is approximately equal to the diameter of the shield.

4. The contact according to claim 3, wherein a top end of each projection of said first set of projections is formed to have a gradient which extends upwardly away from said shielded wire so that the first set of projections abut the shield of the shielded wire, and wherein a top end of each projection of said second set of projections is formed to have a gradient which extends upwardly toward said shielded wire so that the second set of projections penetrate the shield of the shielded wire.

5. A method of making electrical contact with a shielded wire, comprising:

providing an insulated wire covered by a metal shield;

retaining said wire; and forming an electrically conductive contact with two pairs of elastic piercing projections extending therefrom;

inserting the shielded wire between the first and between the second pair of projections, wherein the first pair of projections is outwardly biased by the insertion of the shielded wire and abuts the metal shield and the second pair of projections is inwardly biased by the insertion of the shielded wire and penetrates the metal shield.

* * * * *